United States Patent [19]

Bakalowits

[11] Patent Number: 4,628,424

[45] Date of Patent: Dec. 9, 1986

[54] CHANDELIER

[76] Inventor: Friedhelm Bakalowits, 17, Halirschgasse, A-1170 Vienna, Austria

[21] Appl. No.: 687,151

[22] Filed: Dec. 28, 1984

[30] Foreign Application Priority Data

Dec. 28, 1983 [AT] Austria ..... 4547/83

[51] Int. Cl.[4] ..... F21V 11/00

[52] U.S. Cl. ..... 362/351; 362/405; 362/311

[58] Field of Search ..... 362/351, 405, 406, 408, 362/32, 806, 84, 241, 245, 247, 252, 307, 308, 311, 326, 333, 328; D11/72–92

[56] References Cited

U.S. PATENT DOCUMENTS

| | | | |
|---|---|---|---|
| 1,293,594 | 2/1919 | Willey | 362/241 |
| 1,741,408 | 12/1929 | Doane et al. | 362/405 |
| 3,791,058 | 2/1974 | Mollica | 362/84 |
| 4,012,630 | 3/1977 | Gareis | 362/32 |
| 4,187,533 | 2/1980 | Hampton | 362/351 |
| 4,349,864 | 9/1982 | Smith | 362/311 |

*Primary Examiner*—Magdalen Y. C. Greenlief

*Attorney, Agent, or Firm*—Fleit, Jacobson, Cohn & Price

[57] ABSTRACT

A chandelier hanging which consists of at least one non-transparent supporting bar and several outer bars surrounding the supporting bar. The supporting bar has a lustrous surface which is reflecting and which reflects rays coming from a light source onto the outer bars. The outer bars consist of transparent or translucent material, preferably glass.

10 Claims, 3 Drawing Figures

CHANDELIER

BACKGROUND OF THE INVENTION

The invention relates to a chandelier hanging which, as a result of its design, gives particularly good light distribution and dispersion and which moreover produces new light effects in the event of slow movements such as occur on chandelier hanging parts even when air movement is only slight.

SUMMARY OF THE INVENTION

The subject of the invention is a chandelier hanging, in which bars consisting of translucent or transparent material receive from a supporting bar, which is irradiated by a light source and the surface of which is reflecting, direct and reflected light which has been refracted several times, with the result that the outer bars give the impression of being light sources themselves.

DETAILED DESCRIPTION

Figure 1:
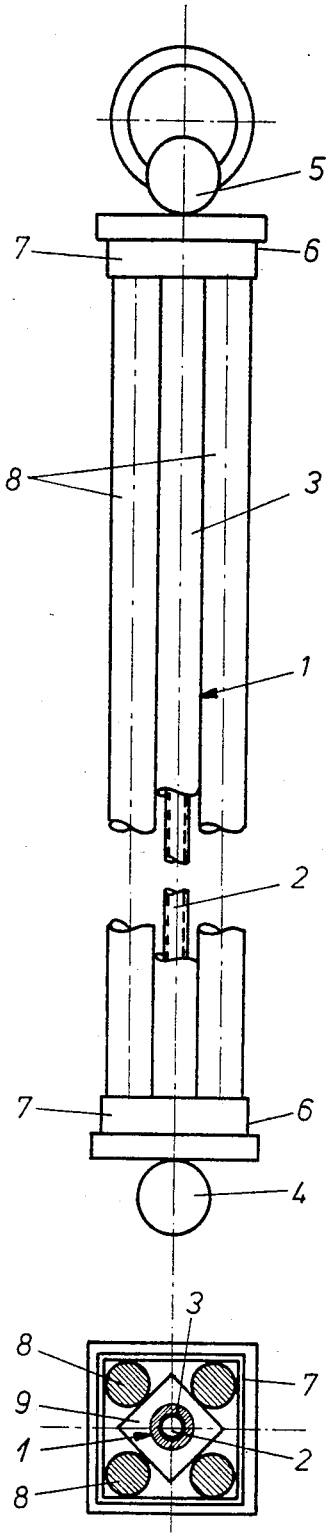
FIG. 1 shows the hanging according to the invention, partially in section.
Figure 3:
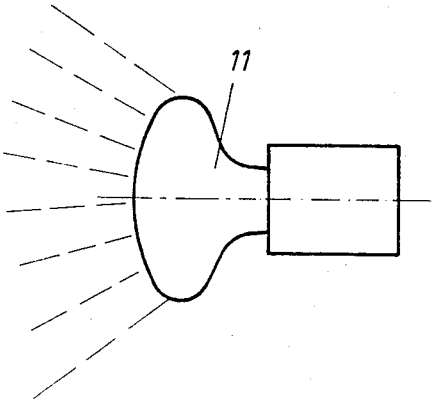
FIG. 3 a longitudinal section of one end.
Figure 2:
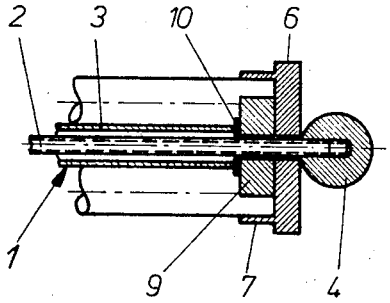
FIG. 2 shows a cross-section.

The hanging according to the invention consists of a supporting bar 1 which, in the example illustrated, has a circular cross-section and which has a constant cross-section over its entire length. The surface of the supporting bar is burnished with a high luster; it consists of metal, for example steel, brass or aluminum alloys of sufficient strength, and can carry an appropriate coating, for example chromium, rhodium or the like, to improve the reflectivity of its cylindrical surface.

The supporting bar 1 consists of a threaded rod 2, onto which is pushed a metal tube 3 having a burnished outer surface. An ornamental nut 4, for example of spherical form, is screwed onto the lower end of the threaded rod 2, and at the upper end a ring nut 5 is located, by means of which the hanging can be fastened to the chandelier or the like.

A supporting plate 6 belongs to each of the two nuts 4, 5. In the example illustrated, the two supporting plates are identical, but they can also have different appearances. The supporting plates 6 have essentially a tub shape, and the encircling edge 7 holds together the outer bars 8 made of transparent material with a high luster surface and the supporting bar. In the exemplary embodiment illustrated, the outer bars have a circular cross-section and are of identical diameter which is constant over their entire length and which is somewhat greater than that of the supporting bar 1. They consist of glass with a preferably high coefficient of refraction; however, they can also be made of synthetic glass (plexiglass, polymethacrylate and the like).

To retain the four outer bars 8 at the correct distance from one another and at a distance from the supporting bar 1, there is in each supporting plate 6 a square spacer piece 9 which is drawn against the metal tube 3 by means of the two nuts 4 and 5, with shims 10 being interposed. The length of the outer bars 8 is somewhat less than the distance between the bottoms of the supporting plates 6, so that, even when the nuts 4, 5 are tightened to a high degree, the outer bars 8 cannot undergo any compressive stress which could result in damage or breakage.

Because the transparent outer bars 8 are arranged at a distance from one another and at a distance from the high-luster surface of the supporting bar 1, and because the diameter or cross-section of the outer bars is made at least equal to, but preferably greater than that of the supporting bar 1, there arises, especially when the hanging is irradiated by lateral light sources, such as, for example, the filament bulb 11 indicated in FIG. 1, as a special effect, above all the impression that the outer bars are themselves the light sources, as a result of the multiple light reflections on the surfaces of the supporting bar and outer bars and the multiple refraction of the direct and reflected light in the outer bars.

Furthermore, a substantially uniform light distribution is achieved, specifically even in high rooms, provided that the hanging according to the invention is of adequate length.

The hanging described can be modified in various ways, without thereby having to depart from the scope of the invention. Thus, the supporting bar or just some outer bars, or even all the outer bars can have cross-sections differing from the circular form, for example the form of polygons, preferably regular polygons. In a further design, the supporting bar and/or some or all of the outer bars can be twisted round the longitudinal axis if they are designed with a polygonal cross-section. This twisting can extend in the same direction for all the bars, but it is also possible to alternate the twisting direction, for example from one outer bar to another, preferably with the supporting bar not being twisted.

Finally, it is also possible to arrange several hangings of the type described round the light source or round part of the latter, thus resulting in a form of light fitting.

What is claimed is:

1. A chandelier hanging comprising a non-transparent supporting bar with a reflecting surface and at least one outer bar extending parallel to the supporting bar and consisting of translucent and substantially transparent material.

2. A chandelier hanging as claimed in claim 1, wherein the supporting bar is provided with a lustrous surface.

3. A chandelier hanging as claimed in claim 1, wherein several outer bars consisting of transparent material are arranged parallel to the supporting bar and at equal angular distances from one another.

4. A hanging as claimed in claim 1, wherein the supporting bar has a circular cross-section.

5. A hanging as claimed in claim 1, wherein the outer bars have a circular cross-section.

6. A hanging as claimed in claim 1, wherein all the outer bars have the same diameter, and wherein their diameter is at least equal to that of the supporting bar.

7. A hanging as claimed in claim 1, wherein the supporting bar and at least some of the outer bars have cross-sections corresponding to polygons, preferably to regular polygons.

8. A hanging as claimed in claim 1, wherein all the outer bars have the same cross-section, and wherein their cross-section is at least equal to that of the supporting bar.

9. A hanging as claimed in claim 1, wherein at least some of the outer bars and the supporting bar are twisted about their longitudinal axes.

10. A hanging as claimed in claim 1, wherein, to retain the outer bars, there are two trough-shaped supporting plates, which can be fixed to the supporting bar and which have an encircling edge, and a spacer piece which is inserted into each of the supporting plates.

* * * * *